US009597647B2

(12) United States Patent
Soeteman et al.

(10) Patent No.: US 9,597,647 B2
(45) Date of Patent: Mar. 21, 2017

(54) MIXER WITH INDIRECT STEAM HEATING AND/OR WATER HEATING OR COOLING

(71) Applicant: B. W. Soeteman B. V., Muiden (NL)

(72) Inventors: Bastiaan Willem Soeteman, Muiden (NL); Anne Jacobus Van Der Lee, Maassluis (NL); Jan Martinetti, Papendrecht (NL)

(73) Assignee: B. W. SOETEMAN B. V., Muiden (NL)

( * ) Notice: Subject to any disclaimer, the term of this patent is extended or adjusted under 35 U.S.C. 154(b) by 0 days.

(21) Appl. No.: 14/780,055

(22) PCT Filed: Mar. 26, 2013

(86) PCT No.: PCT/EP2013/056376
§ 371 (c)(1),
(2) Date: Sep. 25, 2015

(87) PCT Pub. No.: WO2014/154249
PCT Pub. Date: Oct. 2, 2014

(65) Prior Publication Data

US 2016/0051952 A1 Feb. 25, 2016

(51) Int. Cl.

| | |
|---|---|
| ***B01F 9/06*** | (2006.01) |
| ***B01F 15/06*** | (2006.01) |
| ***B01F 9/02*** | (2006.01) |

(52) U.S. Cl.
CPC ..... *B01F 15/06* (2013.01); *B01F 9/02* (2013.01); *B01F 9/06* (2013.01); *B01F 15/065* (2013.01); *B01F 2015/062* (2013.01)

(58) Field of Classification Search
CPC ..... B01F 9/06
USPC ..... 366/147, 149, 225–231
See application file for complete search history.

(56) References Cited

U.S. PATENT DOCUMENTS

| | | | | |
|---|---|---|---|---|
| 111,064 | A * | 1/1871 | Hutchinson | B01D 3/00 100/116 |
| 685,243 | A * | 10/1901 | Atwood | F26B 5/06 165/88 |
| 1,432,028 | A * | 10/1922 | Lister | C11B 1/12 165/90 |
| 2010/0302898 | A1 | 12/2010 | Tölle et al. | |

FOREIGN PATENT DOCUMENTS

| | | |
|---|---|---|
| JP | 2004008385 A | 1/2004 |
| JP | 2004041858 A | 2/2004 |

OTHER PUBLICATIONS

International Search Report and Written Opinion for International Application No. PCT/EP2013/056376 dated Dec. 12, 2013.

* cited by examiner

*Primary Examiner* — David Sorkin
(74) *Attorney, Agent, or Firm* — The Dobrusin Law Firm, P.C.

(57) ABSTRACT

The present invention relates to a mixer with a drum that comprises a mantle, a bottom and a top and which rotates around an axis of rotation.

17 Claims, 6 Drawing Sheets

M-M (1:10)
E-E (1:10)
D-D (1:10)
C-C (1:10)

MIXER WITH INDIRECT STEAM HEATING AND/OR WATER HEATING OR COOLING

The present invention relates to a mixer with a drum that comprises a mantle, a bottom and a top and which rotates around an axis of rotation. The present invention further relates to a method for heating the rotating drum of a mixer.

Such mixers are known from the state of the art and for example produced by the applicant of this patent application. These mixers are particularly utilized for dry mixing, for example of chemicals, food products or the like. In the past, these mixers have been indirectly heated, i.e. the heating medium does not get into contact with the product to be mixed, with water or oil as a heating medium. However, the maximum temperature up to which the mixer can be heated with these transfer media and/or the heat transfer is limited.

It was therefore the objective of the present invention to provide a mixer that can be heated to higher temperatures than mixers according to the state of the art and which is easy to build, to clean and/or to maintain.

This objective is attained with a mixer with a drum that comprises a mid-section, preferably a mantlee, which is closed by two end-sections, which are preferably located at both ends of the mixer, and which rotates around an axis of rotation, wherein the drum is indirectly heated with steam which condenses at least partially and wherein the condensate is collected in a collection pipe, wherein condensate is removed from the mid-section via the collection pipe, wherein the collection pipe (7) is connected to a condensate discharge, characterized in that the collection pipe is at least partially ring shaped, wherein the collection pipe is closed at one location, wherein at least one of the two end-sections comprises heating means. The present invention relates to a mixer, this mixer comprises a drum, which rotates around an axis of rotation, which is preferably arranged horizontally. The rotation of the drum can be continuous or discontinuous. The drum can rotate around the axis of rotation clockwise or counterclockwise. The drum of the mixer comprises a mantle, which is preferably shaped cylindrically and which is closed at both ends, for example with a column-plate. The drum is preferably made from steel, particularly from stainless-steel.

According to the present invention, the drum is heated indirectly with steam, i.e. the product to be mixed is, during the mixing process, never in contact with this heating-steam. During the heating of the drum, the steam condenses at least partially and this condensate is removed from the mixer without touching the product. The person skilled in the art understands, that steam can be added to the product inside the drum in case the recipe requires the addition of steam.

It is advantageously possible with the mixer according to the present invention to discharge the condensate from the mixer in a simple fashion without the need to employ moving parts such as a pump and/or a valve. Thus, a mixer with a simple construction and low weight is provided that has a long life time due to low maintenance requirements. By providing at least one of the two end-sections with heating means it is advantageously possible to further increase the contact surface of the drum with the product to be mixed and condensation and/or solidification of the product to be heated at the end sections can be avoided. The mid-section is hereinafter also called mantle of the drum.

Preferably, the drum comprises at least one, preferably a multitude of internal mixing means. Such an internal mixing means is for example a plate, which is preferably bent. Each internal mixing means is preferably fixed to the drum and more preferably co-rotates together with the drum. Even more preferred, the inventive mixer does not comprise any mixing means which move relative to the drum.

Preferably at least one such internal mixing means and/or the mantle of the drum are heated with steam. Preferably, each internal mixing means comprises one steam inlet and one condensate outlet. The mantle comprises preferably one two or more hollow segments which can be subjected to steam, preferably individually. In case water is used as a heat transfer medium, preferably two or more individual segments are provided. Preferably, the internal mixing means are at least partially hollow. In this hollow volume, the steam is injected and heats the sidewall of the internal mixing means. The mantle comprises preferably two sidewalls, preferably concentric sidewalls, which are spaced apart. In this hollow volume steam and/or water is injected, for example to heat and/or cool the inner sidewall of the mantle. In case of water as a heat transfer medium, the hollow volume between the sidewalls is preferably divided in two or more individual segments. Each segment extends preferably essentially over the entire length of the mantle and more preferably along only a part of the circumference of the inner sidewall. Each segment preferably comprises a steam-inlet and a condensate outlet. The segments are operated in parallel. These segments can be operated in series, for example, in case water is inserted into the hollow volume between the sidewalls.

In a preferred embodiment of the present invention, condensate is removed from each internal mixing means and/or the mantle via a collecting volume, preferably a collection pipe, which is connected to the condensate discharge of one, preferably each, internal mixing means and/or the condensate discharge from the mantle. The collecting volume co-rotates with the drum. Preferably, the collecting volume, preferably the collection pipe, has the same shape as the circumference of the mantle of the drum. More preferably, the collecting volume, preferably the collection pipe, is at least partially ring-shaped. In an even more preferred embodiment of the present invention, the cross section of the collecting volume, preferably the collection pipe, is closed at one position, at least partially. Preferably, one of the ends, more preferably both ends of the collecting volume, preferably the collecting pipe, are closed. Preferably, the collecting volume, preferably the collection pipe, extends at least partially, more preferably entirely beyond the circumference of the drum, i.e the distance of the collecting volume from the centerline is at least locally, preferably entirely, larger than the distance of the mantle of the drum from this centerline.

Preferably, the heating means is a hollow volume, wherein the hollow volume is provided for passing steam through. The injected steam heats a jacketed wall that forms the hollow volume of the at least one of the two end-sections of the drum, preferably the hollow volumes of both end-sections. The end-sections may be end-caps of the drum, preferably made from steel, in particular stainless steel. The hollow volume of the end-sections is preferably formed by two spaced apart walls, preferably parallel arranged walls that have a convex shape. In particular, the hollow volumes of one or both of the end-sections and the mantel are operated independently or in parallel, wherein each of said hollow volumes is heated to the same or a different temperature. In this way, the heating process can be tailored to the product to be heated. Preferably, the hollow volume of the at least one end-sections extends at least partially over the extent of the end-section in a direction perpendicular to an axis of rotational symmetry of the at least one end-section. It is thereby advantageously possible to heat the product to be mixed to a higher temperature as compared to a drum which comprises a hollow volume only in the mid-section or mantle. Preferably, the hollow volume of the end-section is arranged symmetrically around the axis of rotational symmetry of the end-section.

Preferably, the hollow volumes of the at least one end-section is connected with a hollow volume of the mid-section. Preferably, the condensate is removed from the hollow volume of the at least one end-section via the collection pipe, and preferably via the hollow volume of the mid-section. Preferably, both end-sections and the mid-section are all connected such that one hollow volume is formed for the circulation of steam and discharge of the condensate. It is thereby advantageously possible to discharge the condensate from the at least one end-section and the mid-section via the same discharge pipe and direct the condensate to the collection pipe which is connected with the discharge pipe. It is thereby advantageously possible to provide a mixer without moving parts, i.e. without a valve and/or a pump for the discharge of the condensate. Moreover, the mixer can be heated to a high temperature, because the condensate is removed continuously. Preferably, the mid-section has a cylindrical shape, wherein the axis of rotation preferably coincides with an axis of rotational symmetry of the mid-section. Preferably, the condensate is removed from the mid-section and one or both of the two end-sections at least once per revolution of the drum, i.e. once per rotation of 360 degrees around the axis of rotation. Preferably, the at least one end-section has a convex shape, wherein the axis of rotation preferably coincides with an axis of rotational symmetry of the at least one end-section. Preferably, a steam inlet pipe for feeding the drum with stem, a steam outlet pipe and a further condensate discharge pipe connected to the collection pipe are arranged along the axis of rotation of the drum.

Preferably, internal mixing means comprise a condensate collection area in which the condensate is collected before it is discharged. More preferred, the condensate collection area is tilted towards the condensate discharge.

The person skilled in the art understands that, the mixer can also be heated or cooled with water and/or any other fluid medium, wherein the water or other fluid medium is discharged from the mixer in the same way as the condensate is discharged. In this case, i.e. when the mixer is heated or cooled with water and/or oil, in the entire disclosure the subject matter "steam" and "condensate" has to be substituted by the subject matter "water and/or oil and/or any other fluid medium". Particularly, the steam inlet is the water/oil-inlet, whereas the condensate outlet, the condensate collection and/or condensate discharge is the water/oil outlet, water/oil collection and/or the water/oil discharge.

Another subject matter of the present invention is a method for heating the rotating drum of a mixer, with steam, whereas condensate is removed from the mixer discontinuously.

The disclosure made regarding the inventive mixer also applies to the inventive method and vice versa.

According to inventive method of the present invention, the condensate is removed from the mixer discontinuously. Preferably, the discharge takes only place in certain rotational positions of the drum, preferably limited to a rotational segment of <180°, more preferably <150° and even more preferably <120° and even much more preferred <90°.

According to another or a preferred embodiment of the present invention, the condensate is discharged from the mixer, from the internal mixing means and/or from the mantle at least temporarily, preferably entirely, by gravity, i.e. no pump is needed to discharge the condensate.

The disclosure made regarding the inventive mixer and the inventive method also applies to this inventive method and vice versa.

According to a preferred or another embodiment of the present invention, the mixing means and/or at least a segment of the mantle of the drum is heated with steam and the condensate is removed from the mixer and/or from the internal mixing means and/or from the mantle and/or only once per rotation of the drum. The disclosure made regarding the inventive mixer and the inventive method also applies to this inventive method and vice versa.

The inventions are now explained according to FIG. 1-7. These explanations do not limit the scope of protection. The explanations apply to all inventions likewise.

Figure 1:
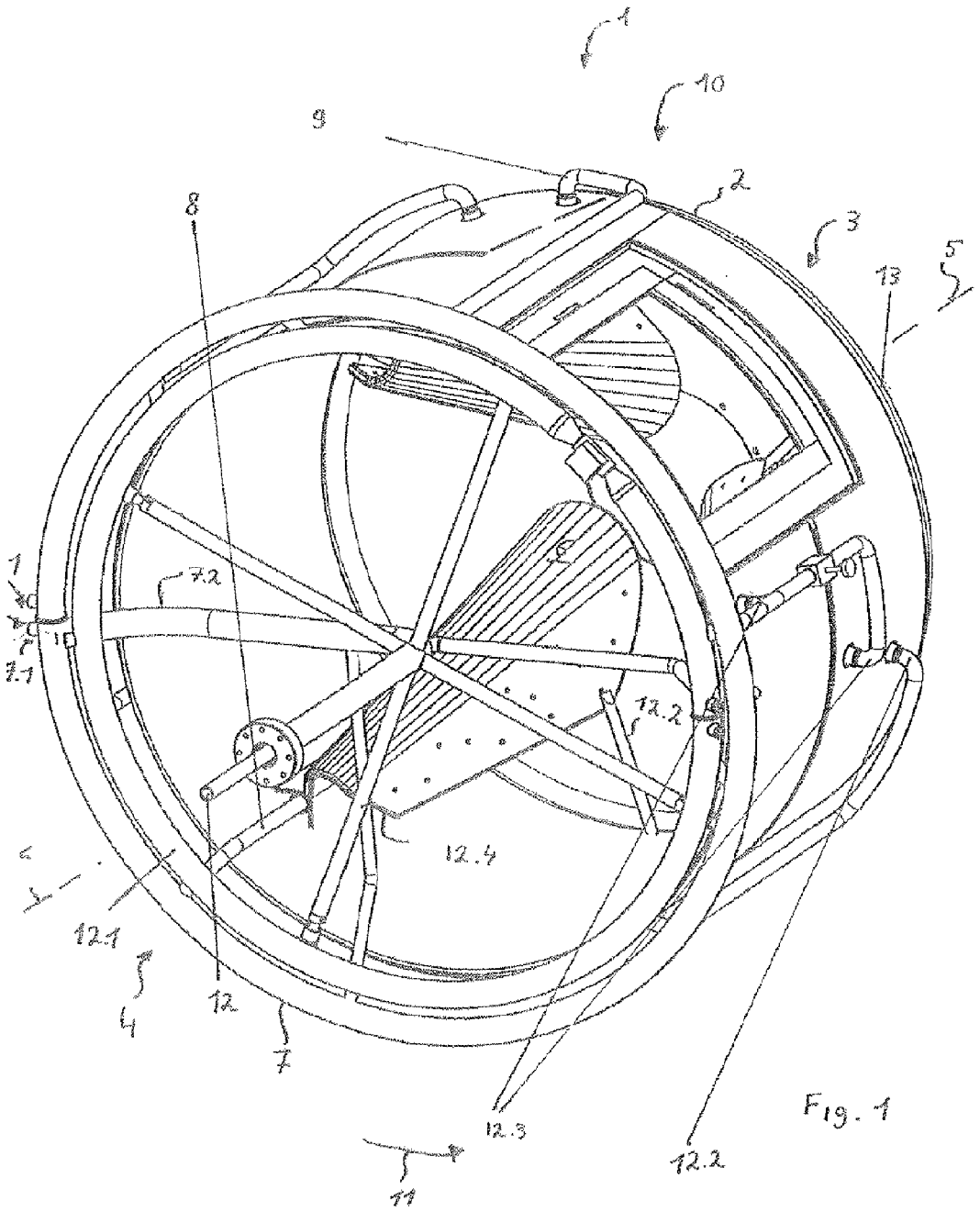
FIG. 1 shows the inventive mixer.

FIG. 1 shows the inventive mixer 1. This mixer comprises a drum 10 with a mantle 2, which is in the present case cylindrical. The mantle 11 is closed at its first and second end 3, 4 by a bottom plate. For mixing purposes, the drum rotates around its axis of rotation 5. In the present case, the mantle 2 of the drum 10 comprises two side walls, which are arranged concentrically and which are spaced apart, so that there is a hollow volume between the two side walls of the drum. Inside, the inventive mixer comprises at least one mixing means 6, which improves the mixing of products within the drum. As can be particularly seen from FIG. 3, this mixing means 6 is hollow, so that steam can be injected into the mixing means 6. In the present case, the hollow volume between the first and the second side wall of the mantle 2 is divided in two separate segments. Each segment extends essentially over the entire axial length of the drum 10 but extends radially only over a segment of a circle. Each of these segments comprises a steam supply 12.3, which is, in the present case, connected to a steam distribution pipe 12.1, which has, in the present case, the shape of a ring. The internal mixing means 6 is also connected to a steam supply via the pipe 12.2 which is also connected to the distribution pipe 12.1. Between the steam inlet 12 and the distribution ring 12.1, a connecting pipe 12.4 is arranged. The steam supply to the segments of the mantle and the internal mixing means 6 is operated preferably in parallel. The steam can be fed to the mixer continuously or discontinuously. During the heating of the mixer the steam supplied condenses and this condensate has to be removed from the internal mixing means 6 as well as from the hollow segments of the mantle 2. For this purpose, each internal mixing means comprises a condensate discharge pipe 8 and each hollow segment of the mantle comprises a condensate discharge pipe 9. The pipes 8, 9 are connected to a condensate collection pipe 7, respectively, in which the condensate is collected prior to discharging from the mixer. In the present case, the condensate collection pipe 7 is designed as a ring, whose radius is larger than the external radius of drum 10. The cross section of this pipe 7 is closed at least partially, preferably entirely, at one position 16, preferably between the two ends 7.1 of the pipe 7. From this pipe 7 a discharge pipe extends from the collection pipe 7 here to the center of the drum, through which the condensate which has been collected in the collection pipe 7 is discharged to the ambient.

The operation of the inventive mixer is as follows:

The mixing material is added and discharged to the drum 10 continuously or batchwise. During the mixing the drum 10 rotates here counter-clockwise as depicted by arrow 11. In order to heat drum 10, steam is supplied via the steam inlet 12. From there the steam flows via pipe 12.4 to the here ring-shaped, steam distribution pipe 12.1. To this steam distribution pipe 12.1 a multitude of pipes 12.3, 12.2 are connected, which supply the steam to the internal mixing means 6 and/or the segments of the hollow mantle, respectively. This steam condenses in the internal mixing means 6 and/or in the mantle 2. This condensate is removed from the individual internal mixing means 6, when its condensate discharge pipe 8 is in a position approximately between 7 and 5 o'clock. The condensate from the mantle is discharged, when the condensate discharge pipe 9 of the mantle is in a rotational position between 7 and 5 o'clock. In these positions, the condensate flows from the internal mixing means 6 and from the hollow volume in the mantle into the condensate collection pipe 7. Since the cross section of this pipe 7 is closed at least partially at position 16, the collected fluid is pushed upwards during the rotation of the pipe and once the discharge pipe has reached approximately the 2 o'clock-position, the collected fluid is discharged via this pipe 7.2 to the ambient. The discharge takes place until the discharge pipe 7.2 has approximately reached the 12 o'clock-position. During the subsequent rotation of the drum, the discharge is repeated. A person skilled in the art understands that during one entire rotation of drum 10, each internal mixing means 6 and each segment in the mantle 2 is emptied from condensate only once. No pump is needed for the discharge of the condensate. Once the condensate in the collection pipe 7 has been lifted over a certain height in the collection pipe 7, due to the rotation of the collection pipe 7, the discharge takes place by gravity.

FIG. 2-7 show construction details of the inventive mixer. As can be particularly seen from FIG. 3, in the present case, the mixer comprises a multitude, here three internal mixing means 6, which are all hollow, so that steam can be injected into the internal of these mixing means 6, where it condenses and thereby heats the product to be mixed. The means 6 are fixed to the drum 10 and co-rotate with drum 10. There are no moving parts in the drum. As can be also seen from FIG. 3, the inventive mixer comprises preferably support means 14 to support the steam inlet 12 and discharge outlet 7.2 and/or the rotational axis of the mixer.

Figures 2, 3, 4, 5, 6, 7:
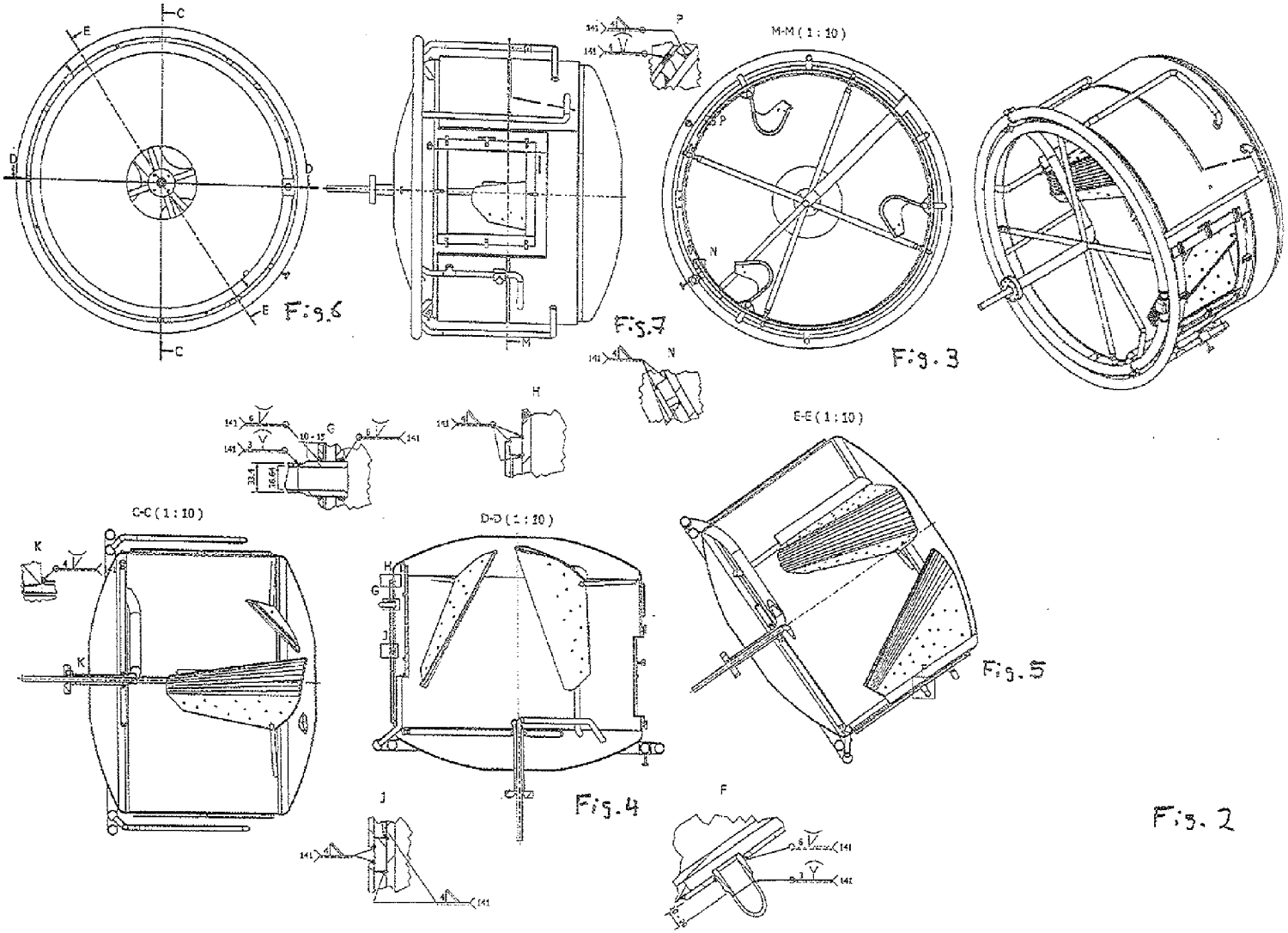
FIG. 2 shows construction details of the mixer according to FIG. 2.
FIG. 3-7 show enlarged drawings shown in FIG. 2.
Figure 3:
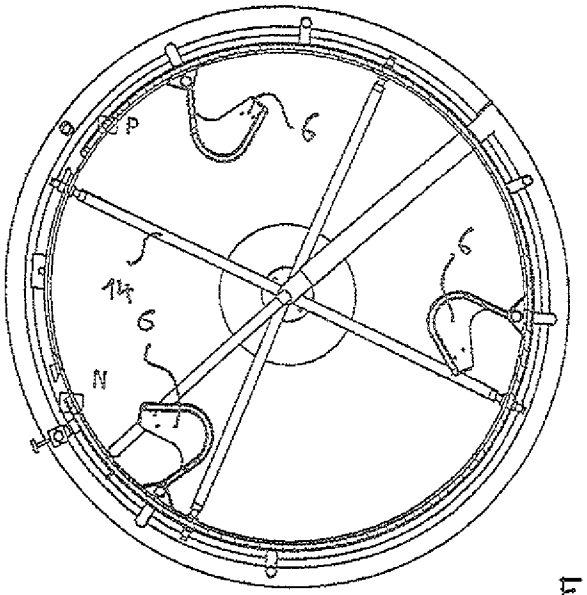
Figure 5:
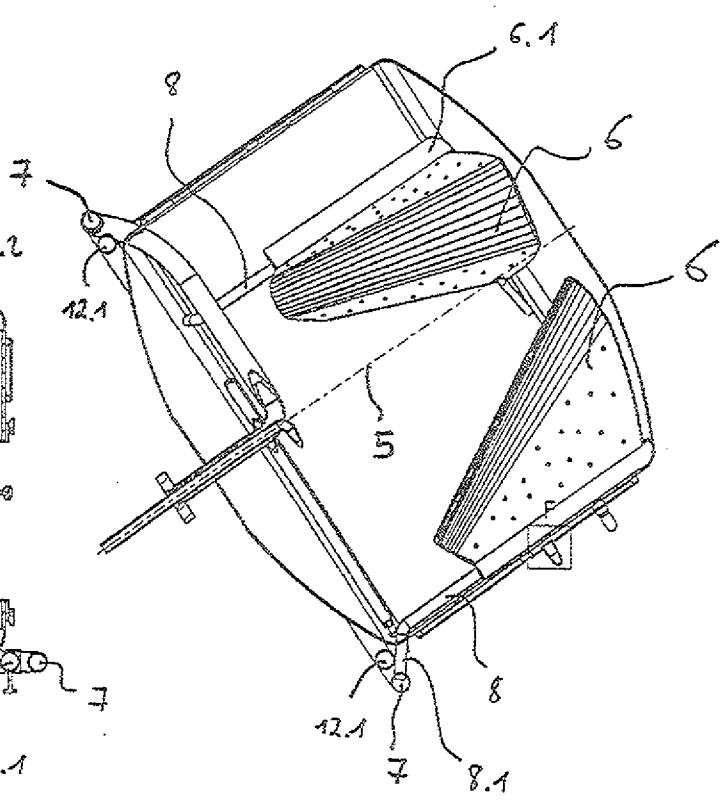
Figure 4:
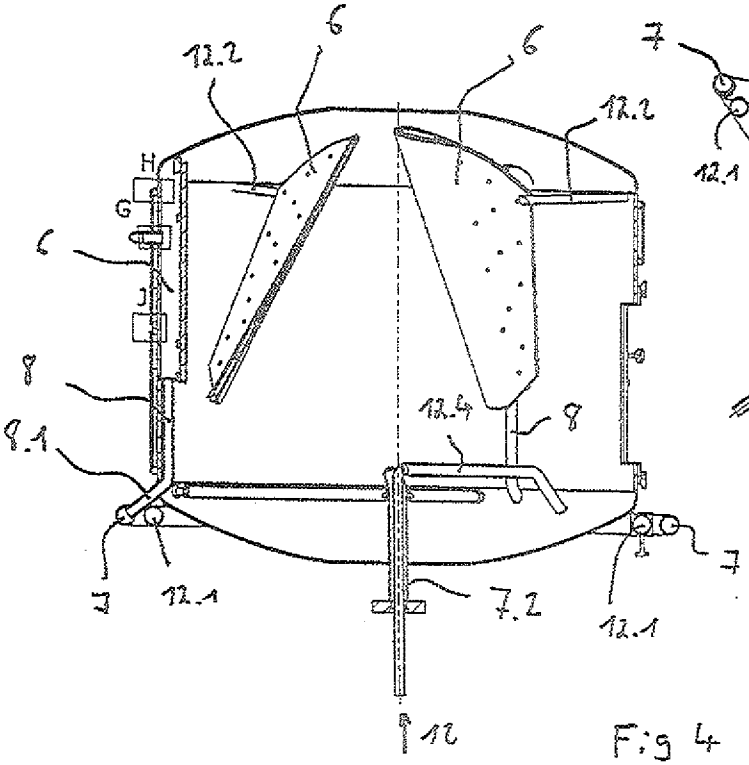
Figure 7:
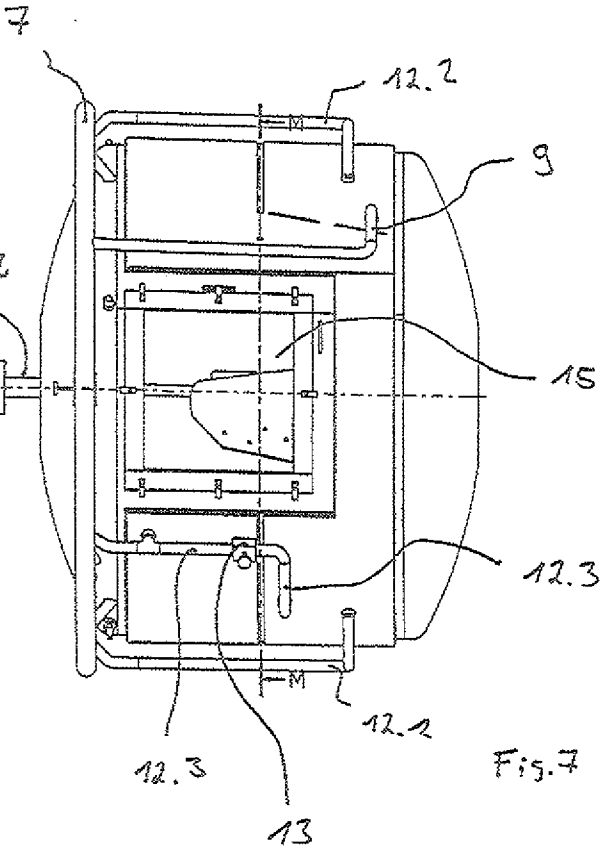
Figure 6:
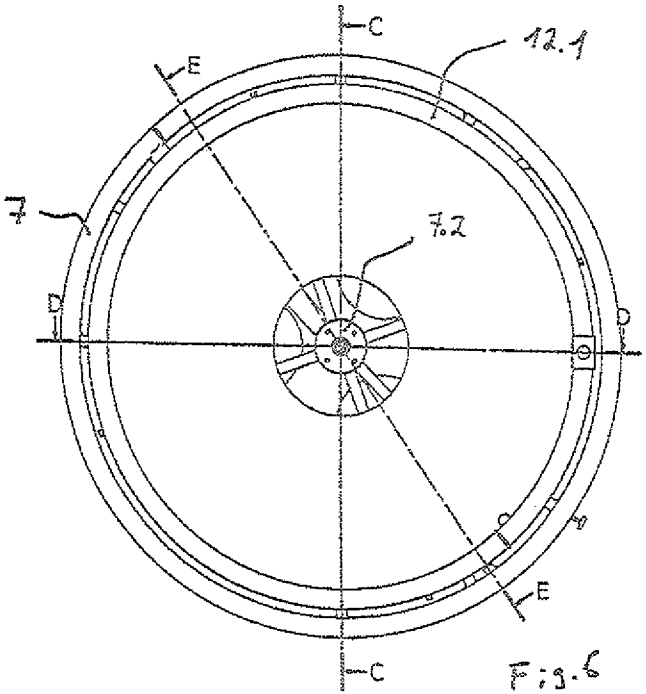

FIG. 4 clearly depicts that the condensate collection pipe 7 is fixed to the drum 10 and co-rotates together with the drum 10 and that the diameter of the collection pipe 7 is larger than the outer diameter of the drum 10. This assures that when a pipe 8 or 9 is in its discharge position, e.g. between the 7 and 5 o'clock-position, the condensate flows downwards by gravity into the collection pipe 7. As can be particularly seen from FIG. 5, the condensate discharge pipe 8 comprises a sloped portion 8.1, which is sloped downwards when this respective pipe 8 is in its discharge position. This also promotes the discharge from the internal mixing means 6 into the collection pipe 7. FIG. 5 also depicts that each internal mixing means 6 comprises a condensate collection area 6.1. In this collection area 6.1 the condensate in the internal mixing means 6 is collected during the rotation of drum 10. From this collection area 6.1 the condensate flows via condensate discharge pipe 8 into the condensate collection pipe 7. The collection area 6.1 is preferably sloped towards the collection pipe 7, to promote the outflow of the condensate.

FIGS. 6 and 7 show, that steam inlet pipe 12 and condensate discharge 7.2 are at least partially arranged concentrically. Furthermore, it can be seen that drum 10 comprises an inspection opening 15. Particularly, from FIG. 7 it can be seen that in the steam supply pipe 12.3 a valve 13 is provided, which is open during steam supply, so that both segments of the hollow mantle 2 are supplied with steam in parallel. In case water is supplied to the hollow mantle, this valve is closed, so that there is only one supply to the mantle. The two segments are now operated in series. In a preferable embodiment, fluid guiding means, e.g. for water, are arranged between the two side walls to improve the heat transfer between the fluid and the inner side wall of the drum 10.

Figure 8:
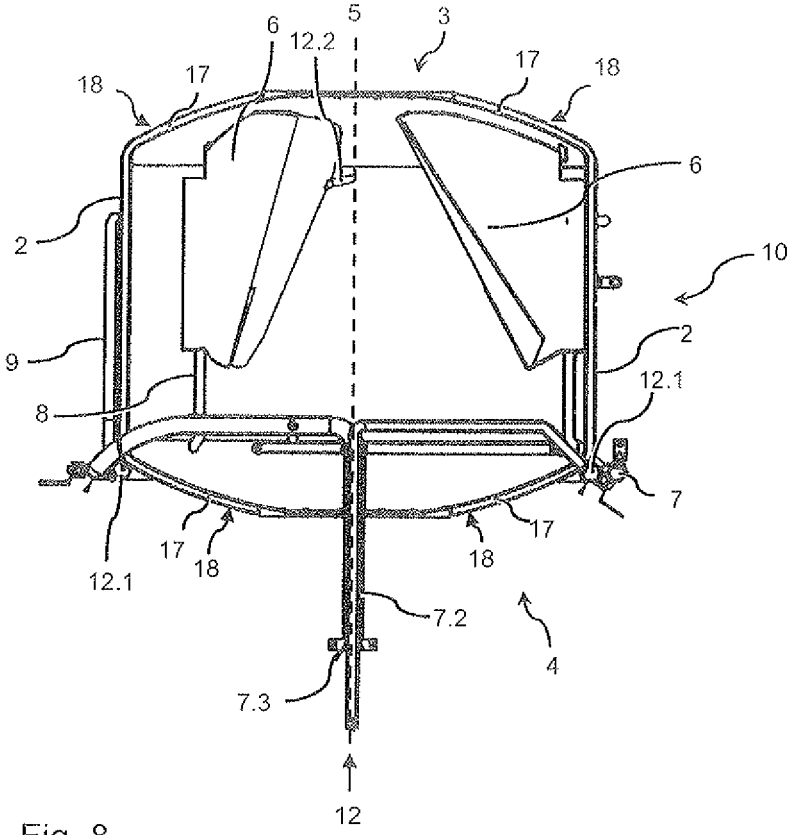
FIG. 8 show a preferred embodiment of the inventive mixer.

FIG. 8 shows a preferred embodiment of the inventive mixer 1. The drum 10 comprises a mid-section 2 and two end-sections 3, 4 enclosing the mid-section 2. In particular, a first end-section 3 is arranged at the bottom of the drum 10 and a second end-section 4 is arranged at the top of the drum 10. The mid-section 2 and both end-sections 3, 4 comprise a hollow volume 17 for the circulation of steam. The hollow volume is formed by spaced apart walls of the drum 10, in particular of the mid-section 2 and the end-sections 3, 4. Here, the hollow volumes 17 of the mid-section 2 and the two end-sections 3, 4 is connected such that one steam chamber 17 is formed that almost completely surrounds the drum 10. In particular, the steam chamber 17 is arranged in the mid-section 2 and partially in both end-sections 3, 4. Preferably, the at least one end-section 3, 4 is single walled in a central area and jacketed with the hollow volume being formed in an peripheral area, wherein the central area is arranged closer to the axis of rotation 5 than the peripheral area. In particular, the at least one end-section 3, 4 has a rotational symmetric shape with the axis of rotational symmetry 5 coinciding with the axis of rotation 5, and in particular with an axis of rotational symmetry 5 of the mid-section 2. The steam is supplied to the hollow volume 17 via the steam inlet 12 and the steam distribution pipe 12.1 and condenses. Preferably, the hollow volume 17 of the at least one end-section 3, 4 is a heating means, i.e. the drum 10 is heated with steam which condenses due to a transfer of heat to the material to be heated. In particular, a condensate discharge 9 is connected to the hollow volume 17 of the mantle 2 or mid-section 2, wherein the condensate discharge 9 is further connected to the collection pipe 7. Preferably, condensate is removed from the hollow volume 17 of the at least one end-section 3, 4 via the collection pipe 7, and preferably via the hollow volume of the mid-section 2. Preferably, the condensate is discharged from the hollow volume 17 of the at least one or both end-sections 3, 4 and the hollow volume 17 of the mid-section 2 once per complete revolution, i.e. once per rotation of the drum around the axis of rotation 5 by 360 degrees. Here, the mixer 1 further comprises a steam discharge 7.3 for discharging the steam after it passed through the whole drum. Preferably, the steam inlet 12, the discharge of the condensate collection pipe 7.2 and the steam discharge 7.3 are arranged on the axis of rotation 5. Preferably, the mid-section has a cylindrical shape, wherein the axis of rotation preferably coincides with the axis of rotational symmetry of the mid-section 2 and/or the at least one end-section 3, 4 has a convex shape, wherein the axis of rotation 5 preferably coincides with an axis of rotational symmetry of the at least one end-section 3, 4. In an alternative embodiment the hollow volume 17 may be segmented (not shown) for operating the mid-section and/or the first end-section 3 and/or the second end-section 4 separately or independently, in particular by heating the mid-section 2 and/or the at least one end-section 3, 4 at different temperatures.

Figure 9:
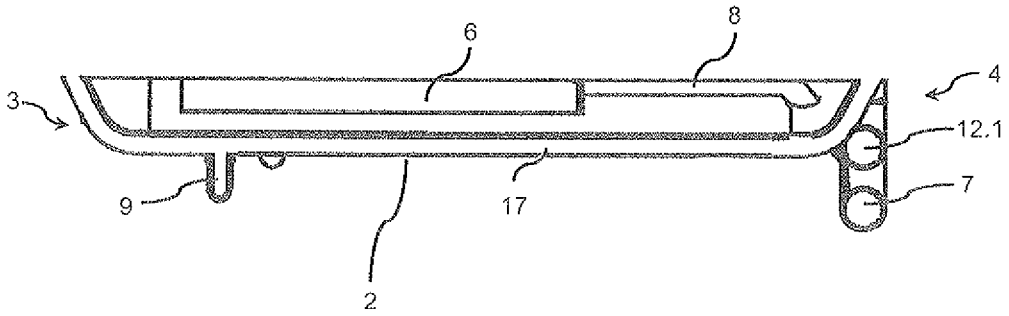
FIG. 9 shows a sectional view of the inventive mixer shown in FIG. 8.

FIG. 9 shows a sectional view of the inventive mixer 1 shown in FIG. 8, i.e. parallel to the axis of rotation 5. The hollow volume 17 of the mantel 2 is connected to the hollow volume 17 of the end-sections 3, 4. The condensate is removed from the hollow volume 17 via the condensate discharge pipe 9 which is connected to the mantle 2 or mid-section. Preferably, the condensate discharge pipe 9 is sloped such that the condensate is collected in the condensate discharge pipe 9 prior to discharging the condensate to the condensate collection pipe 7. Preferably, the condensate collection pipe is at least partially ring shaped and closed at one location such that the condensate is removed only once per revolution or rotation by 360 degrees of the drum 10. Thereby, the condensate is removed discontinuously only once per complete revolution of the drum such that the drum can be heated to high temperatures.

LIST OF REFERENCE SIGNS

1 mixer
2 mantle, mid-section
3 first end, end-section
4 second end, end-section
5 axis of rotation, axis of rotational symmetry
6 internal mixing means, scoop, shovel
6.1 condensate collection area
7 condensate collecting volume, condensate collection pipe
7.1 ends of the condensate collection pipe
7.2 discharge of the condensate collection pipe
7.3 steam discharge
8 condensate discharge of the mixing means 6
8.1 downward slope
9 condensate discharge of the mantle
10 drum
11 direction of rotation
12 steam inlet
12.1 steam distribution pipe
12.2 steam supply to internal mixing means 6
12.3 steam supply to the mantle 2 of the drum 10
12.4 supply from the steam inlet 12 to the distribution pipe 12.1
13 valve
14 support
15 inspection-, cleaning-opening
16 at least partial closing of the inner diameter of the pipe
17 hollow volume
18 jacketed wall

The invention claimed is:

1. A mixer with a drum that comprises, a mid-section which is closed by two end-sections and which rotates around an axis of rotation, wherein the drum is indirectly heated with steam which condenses at least partially and wherein condensate is collected in a collection pipe, wherein the condensate is removed from the mid-section via the collection pipe, wherein the drum comprises et least one internal mixing means and the at least one internal mixing means is heated with steam, wherein the mid-section comprises a mantle, the mantle comprising one or more hollow segments, wherein the at least one internal mixing means comprises a condensate discharge pipe and each hollow segment of the mantle comprises a condensate discharge pipe, wherein the condensate discharge pipe of the at least one internal mixing means and the condensate discharge pipe of the mantle are connected to the collection pipe, in which the condensate is collected prior to discharging from the mixer, wherein the collection pipe is at least partially ring shaped, wherein the collection pipe is closed at one location, wherein at least one of the two end-sections comprises heating means, wherein the at least one internal mixing means comprises a condensate collection area, and in the condensate collection area, the condensate in the at least one internal mixing means is collected during rotation of the drum, and wherein from the collection area, the condensate flows via the condensate discharge pipe of the at least one internal mixing means into the collection pipe.

2. The mixer according to claim 1, wherein the heating means is a hollow volume, wherein the hollow volume is provided for passing steam through.

3. The mixer according to claim 1, wherein the heating means is a hollow volume, and the hollow volume of the at, least one end-section is connected with, a hollow volume of the mid-section.

4. The mixer according to claim 3, wherein the condensate is removed from the hollow volume of the at least one end-section via the collection pipe.

5. The mixer according to claim 1, wherein the mid-section has a cylindrical shape, wherein the axis of rotation coincides with an axis of rotational symmetry of the mid-section.

6. The mixer according to claim 1, wherein the at least one of the two end-sections has a convex shape, wherein the axis of rotation coincides with an axis of rotational symmetry of the at least one end-section.

7. The mixer according to claim 1, wherein the id-section of the drum is heated with steam.

8. The mixer according to claim 1, wherein the drum comprises a multitude of internal mixing means.

9. The mixer according claim 1, wherein the drum comprises at least one, mixing means, and wherein the mixing means are at least partially hollow.

10. The mixer according to claim 1, wherein the condensate is removed from the mid-section via the collection pipe which is connected to the condensate discharge of the mantle.

11. The mixer according claim 1, wherein the collection pipe co-rotates with the drum.

12. The mixer according to claim 1, wherein the collection pipe is closed at the one location at one or both of its ends.

13. The mixer according to claim 1, wherein the collection pipe extends at least partially beyond the circumference of the drum.

14. The mixer according to claim 1, wherein the condensate collection area is tilted towards the condensate discharge pine of the at least one internal mixing means.

15. The mixer according to claim 4, wherein the condensate is removed from the hollow volume of the at least one of the two end-sections via the hollow volume of the mid-section.

16. The mixer according to claim 1, wherein the mid-section comprises two spaced apart sidewalls.

17. The mixer according to claim 9, wherein the mid-section comprises two spaced apart sidewalls.

* * * * *